US006546905B2

(12) United States Patent
Dürr et al.

(10) Patent No.: US 6,546,905 B2
(45) Date of Patent: Apr. 15, 2003

(54) VALVE DRIVE MECHANISM FOR AN INTERNAL COMBUSTION ENGINE

(75) Inventors: Bernhard Dürr, Stuttgart (DE); Harald Schliemann, Waiblingen (DE); Manfred Rabis, Schorndorf (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/944,765

(22) Filed: Aug. 31, 2001

(65) Prior Publication Data

US 2002/0026918 A1 Mar. 7, 2002

(30) Foreign Application Priority Data

Sep. 2, 2000 (DE) ..... 100 43 232

(51) Int. Cl.[7] ..... F01L 1/18

(52) U.S. Cl. ..... 123/90.41; 30/381; 30/383; 30/277.4

(58) Field of Search ..... 30/381, 380, 387, 30/272.1, 277.4, 517, 383, 384, 382; 123/90.39, 196 R, 90.41

(56) References Cited

U.S. PATENT DOCUMENTS 5,029,393 A * 7/1991 Nagashima et al. ..... 30/383

* cited by examiner

*Primary Examiner*—Thomas Denion
*Assistant Examiner*—Jaime Corrigan
(74) *Attorney, Agent, or Firm*—R W Becker & Associates; R W Becker

(57) ABSTRACT

A valve drive mechanism is provided for an internal combustion engine, especially a four-stroke engine in a power chain saw. The implement housing is spanned by a front handle, the tubular grip of which is adjacent to the cylinder head of the engine and extends from one longitudinal side of the implement to the other longitudinal side thereof. A rocker arm of a valve control is pivotably mounted on the cylinder head between the ends of the rocker arm, with the rocker arm being pivotable about a pivot axis disposed transverse to the rocker arm. Push rods of a control mechanism engage one end of the rocker arm to actuate a poppet valve, on the valve stem of which the other end of the rocker arm acts. To be able to guide the tubular grip close to the center of gravity of the implement, the longitudinal axis of the rocker arm is disposed approximately parallel to the adjacent portion of the tubular grip.

13 Claims, 6 Drawing Sheets

VALVE DRIVE MECHANISM FOR AN INTERNAL COMBUSTION ENGINE

BACKGROUND OF THE INVENTION

The present invention relates to a valve drive mechanism for an internal combustion engine for a portable, manually guided implement, especially a power chain saw.

Small four-stroke engines are known for portable, manually guided implements such as power chain saws, brush cutters, blowers, cut-off machines, or the like. Due to their type of construction with a valve drive mechanism, such engines have a greater overall size in the longitudinal axis of the cylinder than do port-controlled two-stroke engines. Portable, manually guided implements such as power chain saws have an implement housing with a rear handle, as viewed in the longitudinal direction of the housing, as well as a front, upper handle that is generally embodied as a tubular grip. The tubular handle extends form the region of the rear handle from one longitudinal side of the housing of the implement, over the upper side thereof, at an angle toward the front to a forward point of attachment, which is provided on the other longitudinal side of the housing. In order to be able to grip the handle with one hand, it must be appropriately spaced above the implement housing, i.e. above the internal combustion engine contained therein. In so doing, the tubular handle is disposed close to the cylinder head, so that due to the necessary free space relative to the handle a large cylinder requires a correspondingly greater path or orientation for the tubular handle. However, this results in a greater spacing of the handle relative to the center of gravity of the portable implement, which can adversely affect the ability to handle the implement. During use of a valve-controlled internal combustion engine, due to the valve drive that is disposed in the cylinder head the increased spacing of the tubular handle from the center of gravity must be accepted.

It is therefore an object of the present invention to provide a valve drive mechanism for a valve-controlled internal combustion engine such that when used in a portable implement a tubular handle that traverses the housing can be guided closer to the center of gravity of the implement.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
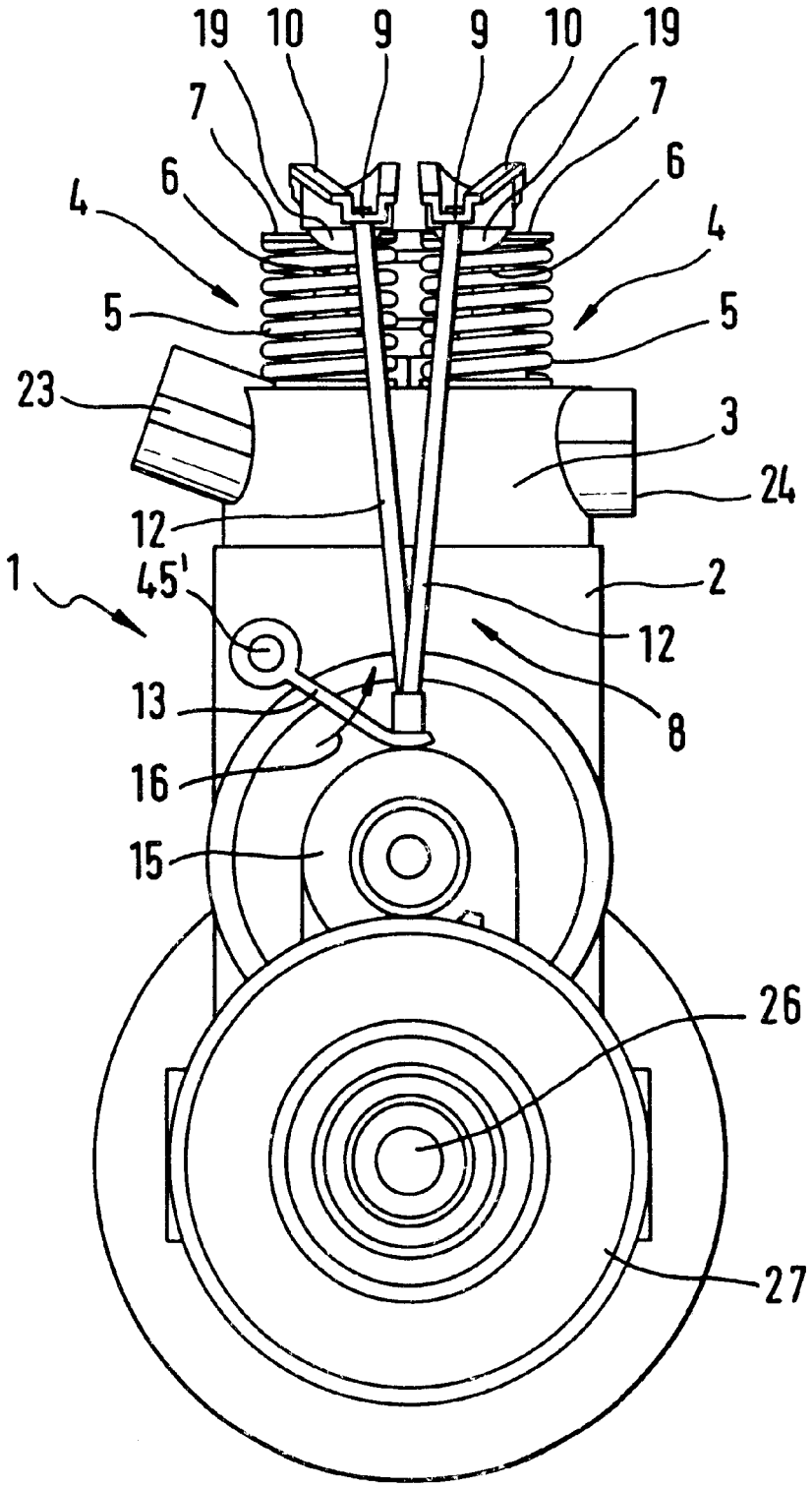
FIG. 1 shows a four-stroke engine having poppet valves actuated by push rods.

The valve drive mechanism of the present invention is provided for an internal combustion engine of a portable, manually guided implement having an implement housing and a handle that spans the housing and that has a tubular grip disposed adjacent to a cylinder head of the engine, wherein the tubular grip extends from one longitudinal side of the housing to the other longitudinal side thereof; the valve drive mechanism further comprises a valve control having a rocker arm that is pivotably mounted on the cylinder head between the ends of the rocker arm, wherein the rocker arm is pivotable about a pivot axis that is disposed transverse to the longitudinal axis of the rocker arm, wherein such longitudinal axis extends approximately parallel to the adjacent portion of the tubular grip, and wherein a control mechanism is provided that acts on one of the ends of the rocker arm for actuating a poppet valve having a valve stem on which the other end of the rocker arm acts.

By orienting the position of that rocker arm that is immediately adjacent to the tubular handle in conformity with the transverse position of the handle itself, it is possible to provide a guidance of the handle closely adjacent to the cylinder head without thereby adversely restricting the free space between the handle and the implement housing that is necessary for grasping the handle. Thus, even when used with a valve-controlled internal combustion engine, especially a four-stroke engine, in a power chain saw, the spacing of the front tubular handle relative to the center of gravity of the implement can be kept to a minimum. Especially with the greater weight of a four-stroke engine, due to the type of construction, the position of the tubular handle close to the center of gravity of the implement is advantageous for being able to operate the implement without fatigue.

The position of installation of the internal combustion engine in the power chain saw is expediently such that the rocker arm that is disposed approximately parallel to the adjacent portion to the tubular handle controls the exhaust valve of the internal combustion engine. The tubular handle itself extends above the exhaust channel of the internal combustion engine and, when viewed from above, preferably over the inlet into the muffler.

The second rocker arm, which controls the intake valve, is offset in the direction of the longitudinal axis of the first rocker arm by a distance that corresponds approximately to the axial width of a control cam of the valve control mechanism. As a result, in the longitudinal direction of the implement the valve drive mechanism can be narrow; the rocker arms that control the intake and exhaust valves are disposed closely adjacent to one another.

In addition, the rocker arms are advantageously disposed at an angle relative to one another, with the ends of the rocker arms that are actuated by the push rods of the control mechanism facing the apex of the angle. As a result, also the push rods can be disclosed closely adjacent to one another, so that the push rods themselves can be disposed in a common protective tube that, due to the position of the push rods close to one another, can be small.

To minimize disruption of the cooling of the air-cooled cylinder by the protective tube, the latter, at least in the direction of flow of the cooling air, is provided with a flow cross section that reduces the resistance to flow. The protective tube preferably has an outer configuration that is drop-shaped in cross section.

Further specific features of the present invention will be described in detail subsequently.

DESCRIPTION OF PREFERRED EMBODIMENTS

Referring now to the drawings in detail, the internal combustion engine 1 schematically illustrated in FIG. 1 essentially comprises a cylinder 2, in the cylinder head 3 of which are provided poppet valves 4, which are not shown in detail. FIG. 1 shows the valve springs 5, which surround the valve stems 6. One end of each valve spring 5 is supported on the cylinder head 3, while the other end is supported on a valve disk 7 that is secured to the valve stem such that it is axially non displaceable.

Each valve stem 6 of the poppet valves 4 is actuated by means of a control mechanism 8 that by means of a push rod 12 engages one end 9 of a rocker arm 10 that is mounted on the cylinder head 3. The end of the valve stem 6 of the poppet valve 4 rests against the other end 11 (see FIG. 4) of the rocker arm 10.

The valve control mechanism 8 essentially comprises push rods 12 that are respectively associated with a rocker arm 10. One end of each push rod 9 is held on a drag or contact lever 13, while the other end is fixed in position in a recess 14 in the end 9 of the rocker arm 10.

The drag lever 13 rests upon the cam surface of a control cam 15 and, in conformity with the cam configuration, actuates the drag lever 13 in the direction of the arrow 16. In so doing, the push rod 12 is axially displaced in the same direction, as a result of which the rocker arm 10 is pivoted about its pivot axis 17, which is disposed transverse to its longitudinal direction. For this purpose, the rocker arm 10 is held on the cylinder head 3 by means of a support pin 18.

Figure 2:
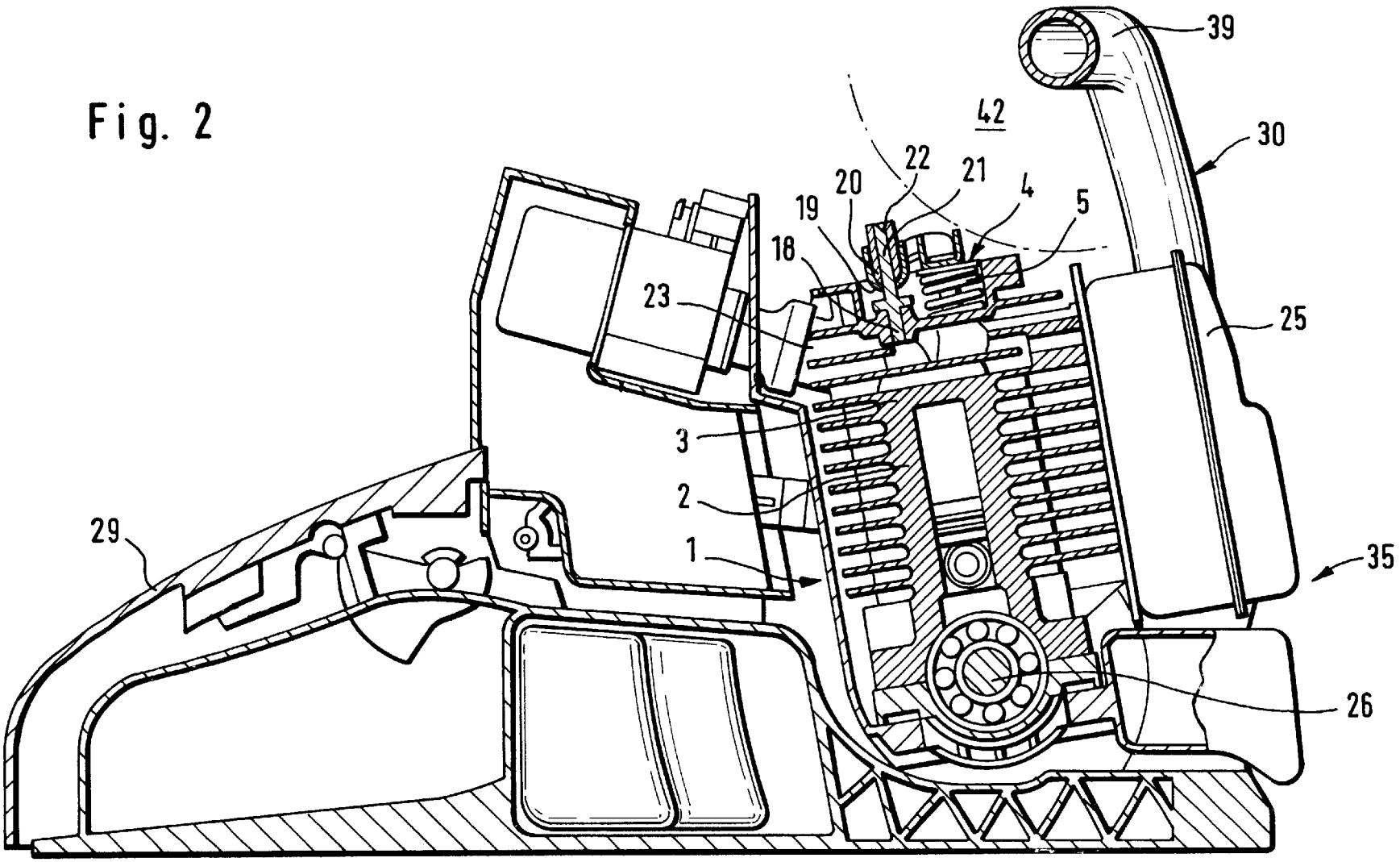
FIG. 2 is a cross-sectional view through a portable, manually guided implement, namely a power chain saw having an internal combustion engine pursuant to FIG. 1.

The mounting is formed by a ball socket 19 that is provided on the rocker arm 10 and that cooperates with a corresponding hemispherical bearing portion 20 of the support pin 18 (see FIG. 2). In the illustrated embodiment, the support pin 18 is a stay bolt that is tapped into the cylinder head 3; the bolt shaft 21 that projects from the cylinder head 3 is provided with a thread onto which is screwed a threaded head 22 that is embodied as a nut. In the illustrated embodiment, the threaded head 22 is monolithically formed with the hemispherical bearing portion 20. By screwing the threaded head 22 on, the bearing distance to the cylinder head 3 can be altered, as a result of which the valve play can be adjusted.

Upon actuation of the push rod 12, the rocker arm 10 pivots about the spherical mounting and presses the respective stem 6 of the poppet valve 4 down in order to open the intake or exhaust valve. The intake valve communicates with an intake channel 23 by means of which the fresh mixture is supplied. The exhaust valve communicates with an exhaust gas channel 24 that opens into a muffler 25 (see FIG. 2).

The control cams 15, which are embodied separately or in common for the intake valve and the exhaust valve, are driven by the crankshaft 26 of the internal combustion engine 1, and preferably via a gear assembly, a chain drive or a belt drive. The crankshaft rotates in a crankcase 27.

The rocker arm 10 of the valve drive mechanism is spring loaded by the respective valve spring 5. The valve force acts via the end 11 of the rocker arm 10 upon the end 9 of the rocker arm that is at the push rod side, and acts further via the push rods 12 upon the drag lever 13 so that the latter is held in engagement against the cam surface of the control cam 15. If the threaded head 22 is rotated on the threaded shaft 21 in a tightening direction, the bearing spacing "I" is shortened, so that, since the push rod 12 cannot deflect, a pivoting movement of the rocker arm 10 is effected and the valve stem 6 is pressed down. In the opposite direction of rotation of the threaded head 22, the valve stem 6 is displaced by the valve spring 5 in the direction of a closing of the poppet valve 4. By rotating the threaded head 22 and altering the bearing spacing, adjustment of the valve play at the poppet valve 4 is effected.

Figure 3:
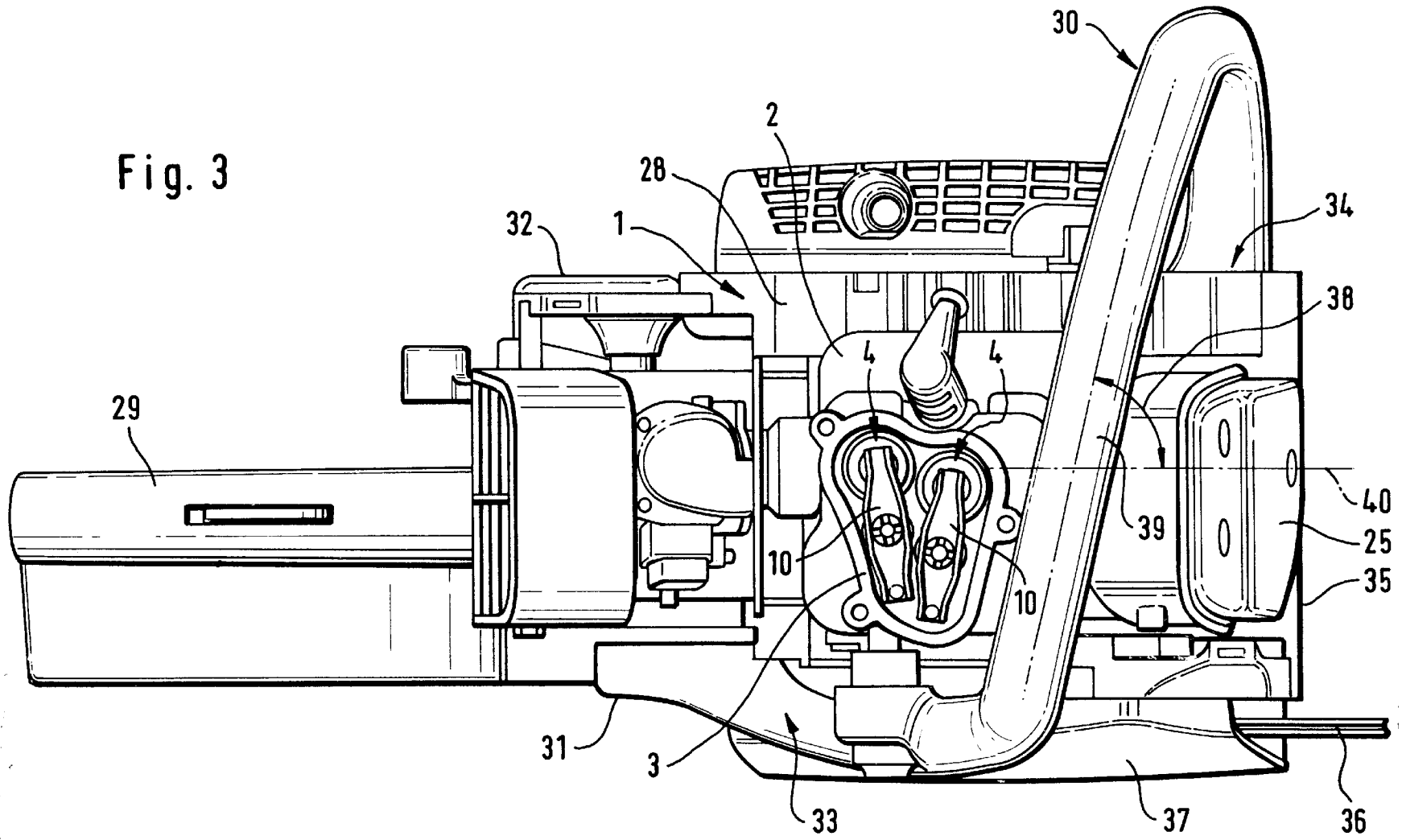
FIG. 3 is a top view of the portable, manually guided implement of FIG. 2 with the valve housing open.

As can be seen from the illustrated embodiment of a power chain saw in FIGS. 2 and 3, in the installed position in the portable, manually guided implement the cylinder head 3 is disposed in the implement housing 28 in such a way that it is next to a front, upper tubular handle 30. The handle 30, which could also be made of solid material, extends from one longitudinal side 31 of the housing 28 to the other longitudinal side 32 of the housing. In the illustrated embodiment of a power chain saw, the point of attachment 33 on the longitudinal side 31 is disposed near a rear handle 29, whereas the point of attachment 34 on the other longitudinal side 32 is disposed near the front end face 35 of the power chain saw. The only schematically illustrated guide bar 36, with the circulating saw chain, is disposed at right angles to the front end face 35 and is held in a clamped manner between the chain or sprocket wheel cover 37 and the implement housing 28.

The rear handle 29 extends approximately in the direction of the longitudinal central axis 40 of the implement housing 28; the guide bar 36 of the saw is disposed approximately parallel to the longitudinal central axis 40.

Due to the selected points of attachment 33 and 34, the handle 30 which spans and is spaced from the upper side of the implement housing 28, is disposed transverse to the longitudinal central axis 40, whereby the angle 38 of the handle portion 39 that is disposed above the implement housing 28, which angle is directed toward the point of attachment 34, is less than 90°. Thus, the handle portion 39 that extends above the implement housing 28 extends from the point of attachment 33 on the longitudinal housing side 31 at an incline in the direction toward the front end face 35.

Figure 4:
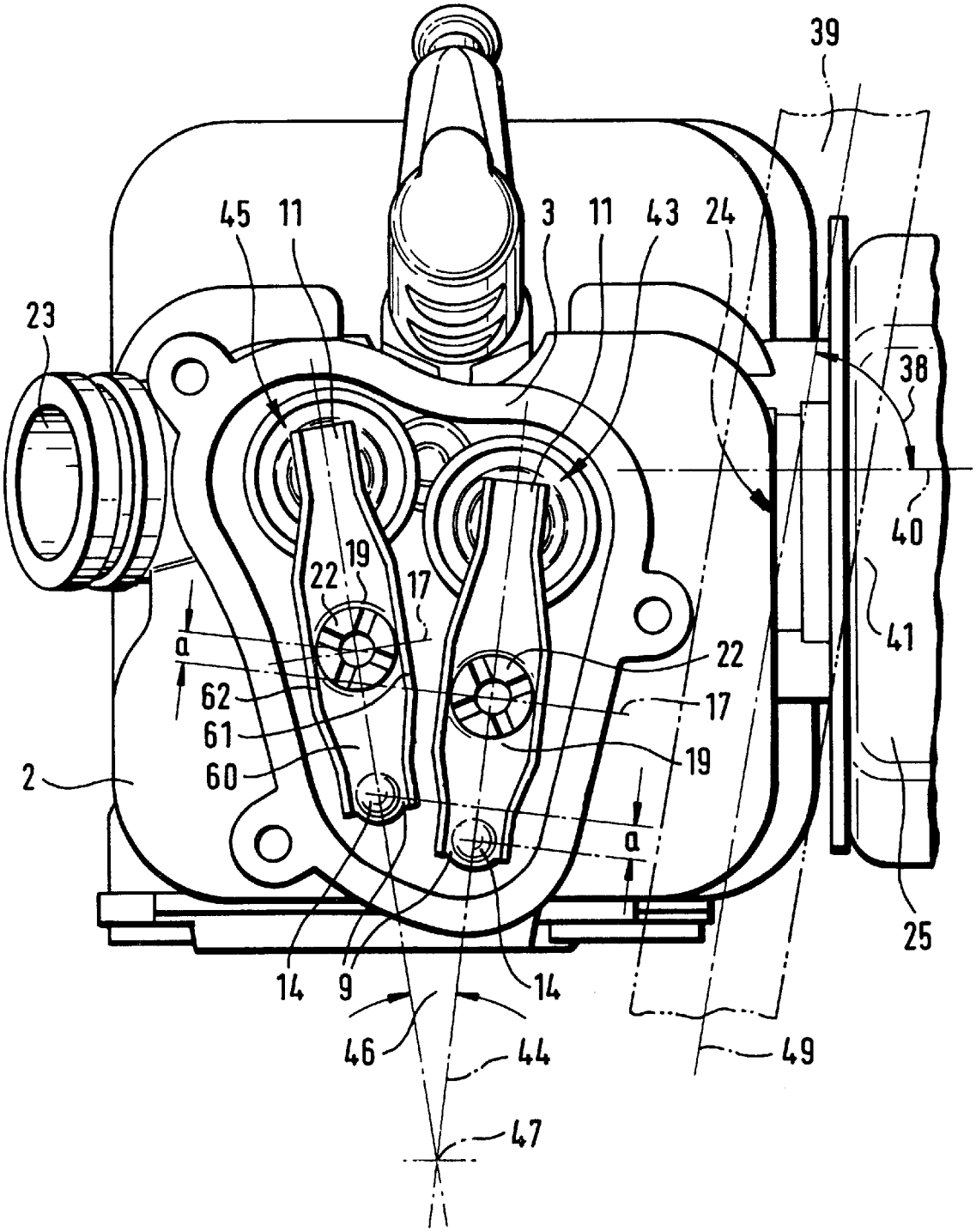
FIG. 4 is an enlarged view of the valve housing of FIG. 3.

As can also be seen from FIG. 4, the handle portion 39 is disposed above the exhaust gas channel 24 of the internal combustion engine 1 approximately in the region over the inlet 41 of the muffler 45. In order to provide an adequately large gripping space 42 between the upper handle portion 39 and the cylinder head 3, the position of the rocker arm 10 that is disposed adjacent to the handle 30 is selected such that the longitudinal axis 44 of the rocker arm extends approximately parallel to the adjacent portion 39 of the handle 30. Thus, while providing an adequately large gripping space 42, the handle 30 can be guided close to the implement housing 28 without having disruptive portions of the valve housing, which the rocker arm spans, projecting into the gripping space.

In this connection, the position of the internal combustion engine 1 is selected such that the muffler 25 faces the front end face 35, in other words the working region, and the rocker arm 10 that is disposed approximately parallel to the upper handle portion 39 controls the exhaust valve 43. The internal combustion engine 1, which is embodied as a valve-controlled two-stroke or four-stroke engine, is provided with a respective intake valve 45 and an exhaust valve 43. The second rocker arm 10, which is disposed in the valve housing, controls the intake valve 45, whereby the pivot bearing of the intake valve that is formed on the support pin 18 is offset in the direction of the longitudinal central axis 44 of the first rocker arm 10 by a distance "a". In conformity therewith, the recesses 14 in the ends 9 of the rocker arm 10 that are at the push rod side have an offset "a" relative to the longitudinal central axis 40 of the implement. In this connection, the distance or offset "a" corresponds approximately to the axial width of the control cam 15 of the control mechanism 8 to the extend that, as illustrated in FIG. 1, the control cams 15 for the intake valve 45 and the exhaust valve 43 are embodied separate from one another and respectively cooperate with a drag lever 13. In this connection, the drag levers 13 can be mounted on a common shaft or axis 45.

The first rocker arm 10, which controls the exhaust valve 43 and is disposed approximately parallel to the handle portion 39, i.e. to the longitudinal central axis 49 thereof, and the second rocker arm 10 which controls the intake valve 45, have their longitudinal axes form an angle 46 relative to one another that in the illustrated embodiment is approximately 15°. The angle 46 can range from 10–30°.

Those ends 9 of the rocker arms 10 that are actuated by the push rods 12 of the control mechanism 8 face the apex 47 of the angle 46, so that in the longitudinal direction of the longitudinal central axis 40 of the implement, i.e. of the internal combustion engine 1, only a small overall width results so that, as shown in FIG. 1, the push rods can extend closely adjacent to one another.

Figure 5:
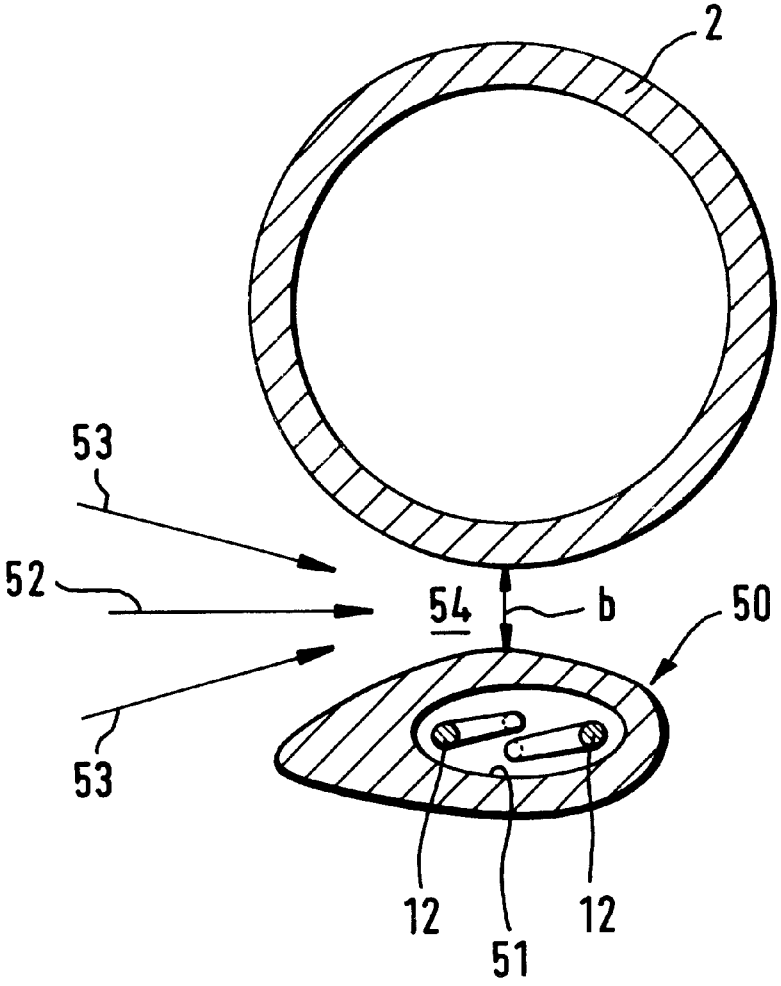
FIG. 5 is a schematic illustration of the cylinder and a protective tube, for push rods, that is spaced from the cylinder in the upright position of the cylinder.

The close position of the push rods 12 relative to one another structurally provides the possibility for guiding the push rods 12 in a common protective tube 50, as schematically illustrated in FIG. 5. The protective tube 50 has an inner, oval cross section 51, in the oppositely disposed ends of which the push rods 12 extend. The cylinder 2, which is similarly shown only schematically in FIG. 5, is an air-cooled cylinder having fins or ribs, as can be seen, for example, in FIGS. 2 and 4. The protective tube 50 extends next to the vertical cylinder 2 at a lateral spacing "b" therefrom. In order to ensure an adequate cooling of the cylinder 2 in the region of the protective tube 50, the protective tube, at least on that side thereof that faces the direction of flow 52 of the cooling air 53, is embodied as a flow body that reduces the resistance to flow, with the protective tube 50 preferably having an outer, drop-shaped flow cross section, as shown in FIG. 5. This configuration forces the cooling air 53 into the gap 54 between the cylinder 2 and the protective tube 50. The danger of clogging due to dirt, wood chips, or the like is minimized while at the same time ensuring a good air cooling of the cylinder 2, even in the region of the protective tube 50.

Figure 6:
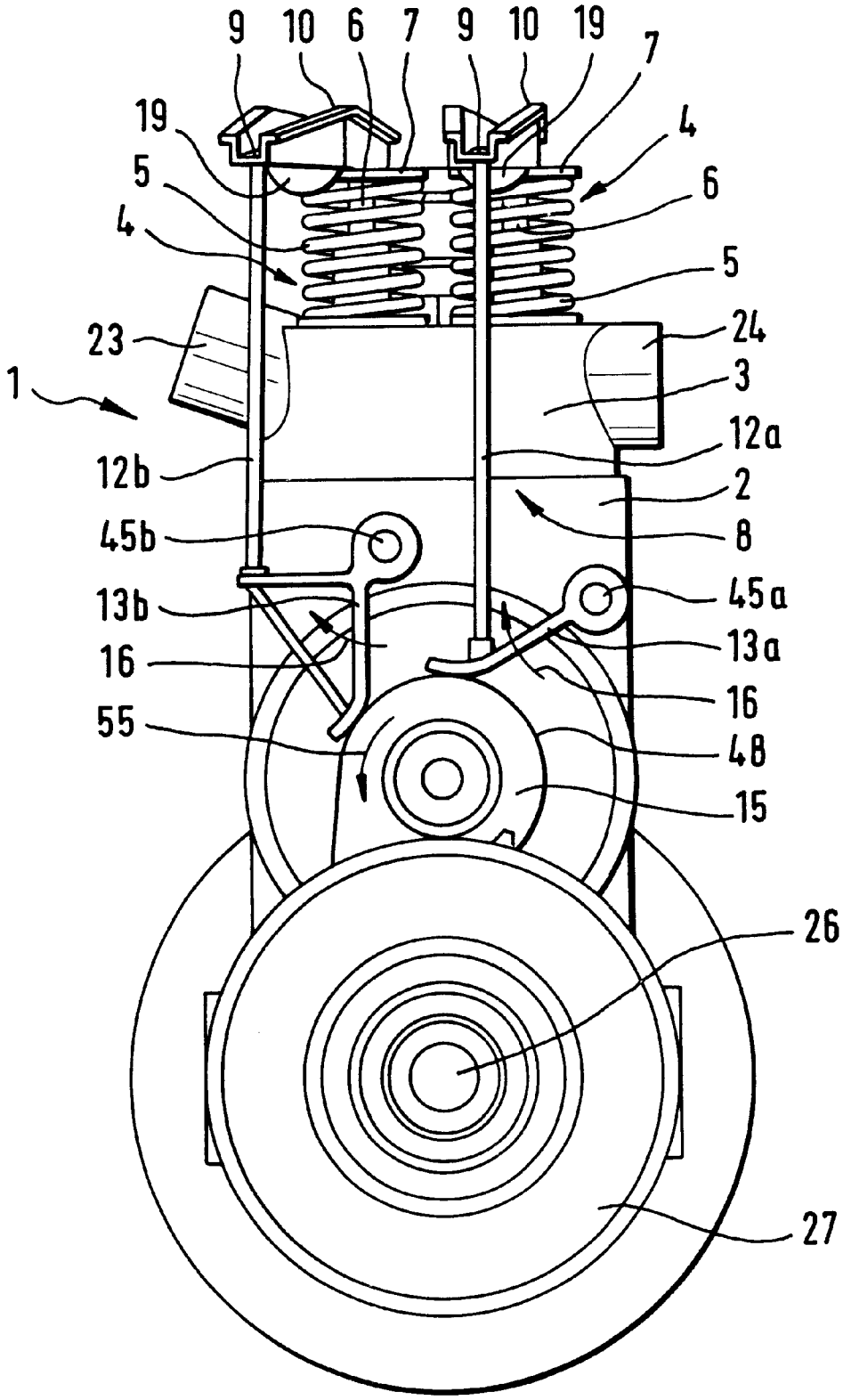
FIG. 6 shows a four-stroke engine of a modified embodiment having push rods actuated by a common control cam.

It can be expedient to embody the control mechanism 8 of the valve control in such a way that each push rod 12*a*, 12*b* via a separate drag lever 13*a*, 13*b* runs on a common cam surface 48. In this connection, only a single control cam 15 is provided, on the cam surface 48 of which the drag levers 13*a*, 13*b* are disposed one after the other as viewed in the direction of rotation 55. Both of the drag levers 13*a* and 13*b* are towed or dragged; due to the identical cam contour, the stroke of both drag levers is the same. Each drag lever is expediently mounted via its own axis of rotation 45*a*,45*b*. In other respects, the construction of the internal combustion engine 1 of FIG. 6 corresponds to that of FIG. 1, for which reason the same reference numerals have been used for the same part.

The rocker arms 10 are advantageously produced as shaped parts that are made in particular from a sheet of steel. As shown in FIG. 4, each rocker arm 10 has a base 60 that is provided with the ball socket 19 between its ends 9 and 11. To reinforce the base 60, the longitudinal edges thereof are provided with side walls 61 and 62, which are preferably monolithically formed on the base. The rocker arm 10 has a U-shaped cross-sectional configuration as can also be seen from FIG. 2. In this connection, the open side of the U-shaped cross section faces away from the cylinder head 3.

The specification incorporates by reference the disclosure of German priority document 100 43 232.8 filed Sep. 2, 2000.

The present invention is, of course, in no way restricted to the specific disclosure of the specification and drawings, but also encompasses any modifications within the scope of the appended claims.

We claim:

1. A valve drive mechanism for an internal combustion engine of a portable, manually guided implement having an implement housing and a handle that spans the housing and that has a tubular grip disposed adjacent to a cylinder head of the internal combustion engine, wherein said tubular grip extends from one longitudinal side of said implement housing to another longitudinal side thereof, said valve drive mechanism further comprising:

a valve control having a rocker arm that is pivotably mounted on said cylinder head between end of said rocker arm, wherein said rocker arm is pivotable about a pivot axis that is disposed transverse to a longitudinal axis of said rocker arm, and wherein said longitudinal axis extends approximately parallel to an adjacent portion of said tubular grip; and a control mechanism that acts on one, of said ends of said rocker arm for actuating a poppet valve having a valve stem on which the other end of said rocker arm acts.

2. A valve drive mechanism according to claim 1, wherein said rocker arm that is disposed approximately parallel to said adjacent portion of said tubular grip controls an exhaust valve of said internal combustion engine.

3. A valve drive mechanism according to claim 1, wherein said control mechanism is provided with at least one push rod that is actuated by a control cam, and wherein that end of said push rod that is remote from said control cam rests against said rocker arm.

4. A valve drive mechanism according to claim 1, wherein a second rocker arm is provided, and wherein a mounting of said second rocker arm is offset, in a direction of said longitudinal axis of said first mentioned rocker arm, by a distance relative to a mounting of said first mentioned rocker arm.

5. A valve drive mechanism according to claim 4, wherein said distance corresponds approximately to an axial width of a control cam of said control mechanism.

6. A valve drive mechanism according to claim 4, wherein said second rocker arm controls an intake valve of said internal combustion engine.

7. A valve drive mechanism according to claim 4, wherein said first mentioned rocker arm, which is disposed approximately parallel to said adjacent portion of said tubular grip, and said second rocker arm are disposed at an angle relative to one another, and wherein said ends of said rocker arms that are actuated by said control mechanism are directed toward an apex of said angle.

8. A valve drive mechanism according to claim 7, wherein said control mechanism includes push rods for said rocker arm, and wherein said push rods are disposed in a common protective tube.

9. A valve drive mechanism according to claim 8, wherein said internal combustion engine has an air-cooled cylinder, wherein said protective tube is spaced from said cylinder, and wherein said protective tube has a flow cross section that relative to a direction of flow of cooling air reduces resistance to flow.

10. A valve drive mechanism according to claim 9, wherein said protective tube has an outer drop-shaped flow cross section.

11. A valve drive mechanism according to claim 8, wherein said protective tube extends over an exhaust channel of said internal combustion engine.

12. A valve drive mechanism according to claim 11, wherein said protective tube is disposed over an inlet of a muffler.

13. A valve drive mechanism according to claim 7, wherein a single control cam is provided for actuating said push rods.

* * * * *